US011445789B2

(12) United States Patent
Dorsey et al.

(10) Patent No.: US 11,445,789 B2
(45) Date of Patent: Sep. 20, 2022

(54) NECKLACE ACCESSORY

(71) Applicants: Jaclyn Dorsey, Woodbridge, CT (US); Joshua Dorsey, Woodbridge, CT (US)

(72) Inventors: Jaclyn Dorsey, Woodbridge, CT (US); Joshua Dorsey, Woodbridge, CT (US)

( * ) Notice: Subject to any disclaimer, the term of this patent is extended or adjusted under 35 U.S.C. 154(b) by 38 days.

(21) Appl. No.: 17/070,681

(22) Filed: Oct. 14, 2020

(65) Prior Publication Data

US 2021/0112929 A1 Apr. 22, 2021

Related U.S. Application Data

(60) Provisional application No. 62/916,831, filed on Oct. 18, 2019.

(51) Int. Cl.
*A44C 15/00* (2006.01)

(52) U.S. Cl.
CPC ..... *A44C 15/005* (2013.01)

(58) Field of Classification Search
CPC ..... A44C 15/003; A44C 25/00; A44C 15/005; A44D 2203/00; A41F 19/00; A41F 1/002; A41F 5/00; A44B 6/00
See application file for complete search history.

(56) References Cited

U.S. PATENT DOCUMENTS 855,833 A * 6/1907 Brown ..... A41F 15/02 24/363
4,754,534 A 7/1988 Helwick
(Continued)

FOREIGN PATENT DOCUMENTS

WO WO-2006134796 A1 * 12/2006 ..... A44C 15/005

OTHER PUBLICATIONS

Blaine R. Copenheaver, International Search Report and Written Opinion of the International Searching Authority, dated Mar. 18, 2021, PCT/US2020/055746.

*Primary Examiner* — Jack W Lavinder
(74) *Attorney, Agent, or Firm* — Michael A. Blake

(57) ABSTRACT

A necklace accessory, the necklace accessory comprising: a folded strap, the folded strap comprising: an inner portion located on one side of a fold of the folded strap; an outer portion located on the opposite side of the fold of the folded strap; an inner internal volume located inside the inner portion; an outer internal volume located inside the outer portion; a first magnet located inside the inner internal volume; a second magnet located inside the outer internal volume, and configured to be magnetically attracted to the first magnet; where the folded strap is configured to removeably attach to a necklace, and the first magnet is configured to magnetically attach to the second magnet with a shirt between the first magnet and second magnet whereby when attached to the necklace and shirt, the necklace accessory prevents the necklace from rotating about a user's neck. A necklace accessory, the necklace accessory comprising: a clothing fastener; a decorative element configured to removeably attach to the clothing fastener; a first flexible length of material extending from the clothing fastener; a second flexible length of material extending from the decorative element; a third flexible length of material attached to the first flexible length of material and second flexible length of material; a necklace fastener attached to the third flexible length of material on an end of the third flexible length of material opposite the first flexible length of material and second flexible length of material, the necklace fastener configured to removeably attach to a necklace worn by a user; where the clothing fastener is configured to removeably attach to the decorative element with a shirt between the clothing fastener and the decorative element, and whereby when the necklace fastener is attached to the necklace and the clothing fastener and decorative element are attached to the shirt, the necklace accessory prevents the necklace from rotating about a user's neck. A necklace accessory, the necklace accessory comprising: a clothing fastener; a decorative element configured to removeably attach to the clothing fastener; a flexible length of material extending from either the clothing fastener or the decorative element; a necklace fastener attached to the flexible length of material on an end opposite either the clothing fastener or the decorative element, the necklace fastener configured to removeably attach to a necklace worn by a user; where the clothing fastener is configured to removeably attach to the decorative element with a shirt between the clothing fastener and the decorative element, and whereby when the necklace
(Continued)

fastener is attached to the necklace and the clothing fastener and decorative element are attached to the shirt, the necklace accessory prevents the necklace from rotating about a user's neck.

9 Claims, 14 Drawing Sheets

(56) References Cited

U.S. PATENT DOCUMENTS

| | | | | |
|---|---|---|---|---|
| 5,279,132 | A | 1/1994 | Swaim | |
| 5,722,260 | A | 3/1998 | Mangano | |
| 5,806,346 | A * | 9/1998 | Schlinger | A44C 5/2071 63/900 |
| 6,857,167 | B2 | 2/2005 | Bishop | |
| 7,412,730 | B2 | 8/2008 | Schroeder | |
| 8,113,013 | B2 * | 2/2012 | Kessler | A44C 15/005 63/3.1 |
| 8,713,762 | B2 | 5/2014 | Bates | |
| 8,769,780 | B1 * | 7/2014 | Segel | A41F 1/002 24/301 |
| 2004/0200236 | A1 * | 10/2004 | Emberson | A44C 15/00 63/23 |
| 2008/0256796 | A1 | 10/2008 | Fix | |
| 2012/0284964 | A1 | 11/2012 | Swanson | |
| 2017/0095045 | A1 | 4/2017 | Porfilio | |
| 2017/0112240 | A1 | 4/2017 | Lee | |
| 2019/0098968 | A1 | 4/2019 | Quintero | |
| 2021/0068507 | A1 | 3/2021 | Patrzyk | |

* cited by examiner

NECKLACE ACCESSORY

CROSS-REFERENCES

This patent application claims priority to provisional patent application No. 62/916,831 filed on Oct. 18, 2019 by Jaclyn Dorsey and Joshua Dorsey, and titled: "NECKLACE ACCESSORY" which provisional application is fully incorporated by reference herein.

TECHNICAL FIELD

The present invention is an accessory for a necklace, and more particularly an accessory for a necklace that prevents the necklace from rotating about the wearer's neck.

BACKGROUND

A necklace has a tendency to move or rotate around the neck of the wearer during many activities. This inevitably leads to the necklace's clasp, (which is used to fasten the necklace on to the wearer's neck and is intended to stay out-of-sight in the rear of the wearer's neck) becoming visible on the front of the wearer. The wearer must frequently check and adjust the position of the necklace clasp, returning it to the rear of the wearer's neck.

During instances where the necklace's clasp has rotated to the front, an observer may suggest to the wearer that the necklace should be re-situated, which can cause embarrassment to the wearer and may make the wearer more self-conscious about wearing necklaces in the future. Aesthetically, a clasp at the front of the neck is not very pleasing.

Thus there is a need for a necklace accessory that overcomes the above listed and other disadvantages.

SUMMARY OF THE INVENTION

The disclosed invention relates to a necklace accessory, the necklace accessory comprising: a folded strap, the folded strap comprising: an inner portion located on one side of a fold of the folded strap; an outer portion located on the opposite side of the fold of the folded strap; an inner internal volume located inside the inner portion; an outer internal volume located inside the outer portion; a first magnet located inside the inner internal volume; a second magnet located inside the outer internal volume, and configured to be magnetically attracted to the first magnet; where the folded strap is configured to removeably attach to a necklace, and the first magnet is configured to magnetically attach to the second magnet with a shirt between the first magnet and second magnet whereby when attached to the necklace and shirt, the necklace accessory prevents the necklace from rotating about a user's neck.

In addition, the disclosed invention relates to a necklace accessory, the necklace accessory comprising: a clothing fastener; a decorative element configured to removeably attach to the clothing fastener; a first flexible length of material extending from the clothing fastener; a second flexible length of material extending from the decorative element; a third flexible length of material attached to the first flexible length of material and second flexible length of material; a necklace fastener attached to the third flexible length of material on an end of the third flexible length of material opposite the first flexible length of material and second flexible length of material, the necklace fastener configured to removeably attach to a necklace worn by a user; where the clothing fastener is configured to removeably attach to the decorative element with a shirt between the clothing fastener and the decorative element, and whereby when the necklace fastener is attached to the necklace and the clothing fastener and decorative element are attached to the shirt, the necklace accessory prevents the necklace from rotating about a user's neck.

Also, the invention relates to a necklace accessory, the necklace accessory comprising: a clothing fastener; a decorative element configured to removeably attach to the clothing fastener; a flexible length of material extending from either the clothing fastener or the decorative element; a necklace fastener attached to the flexible length of material on an end opposite either the clothing fastener or the decorative element, the necklace fastener configured to removeably attach to a necklace worn by a user; where the clothing fastener is configured to removeably attach to the decorative element with a shirt between the clothing fastener and the decorative element, and whereby when the necklace fastener is attached to the necklace and the clothing fastener and decorative element are attached to the shirt, the necklace accessory prevents the necklace from rotating about a user's neck.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1A:
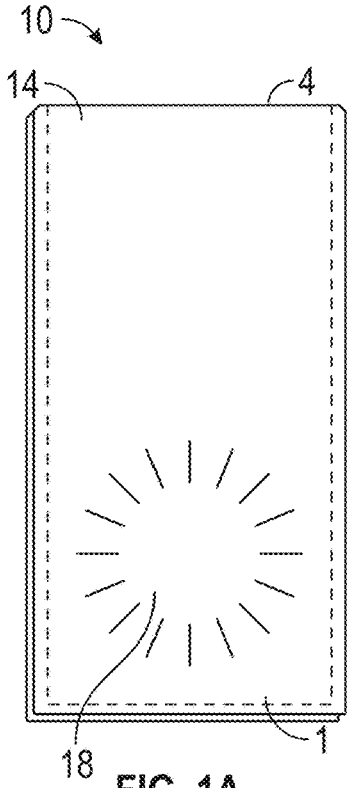
FIG. 1A is a front view of the disclosed necklace accessory.

FIG. 1A is a front view of a necklace accessory 10. The necklace accessory is comprised of a strap 14 that may have neodymium disc magnets 18 sewed-in or otherwise embedded within the strap 14 at opposite ends of the strap 14. The strap may be any type of cloth, fabric, woven material, plastic, silicone, leather, faux-leather, metal, chain, or any other flexible material. The strap is folded halfway, which attaches the two magnets together. The inside of the folded necklace accessory's strap conceals a necklace fastener 22. The fastener may be a clasp fastener such as, but not limited to a lobster clasp, round spring clasp, alligator clip, metal rod, string with ferromagnetic metal material attached, a jump ring, etc. The fastener is attached to the center of the strap, on the inside. The fastener on the necklace accessory is to be attached to the wearer's necklace clasp. Once attached, the back-end of the necklace accessory's strap should be placed behind the wearer's shirt, just below the collar. In this document, a shirt shall be defined to include a shirt, blouse, top, dress, collar, or other garment located near the nape of the neck. The front end of the necklace accessory's strap 14 is to be placed on the outside of the wearer's shirt, at the center of the collar, where the two magnets 18 will attach together and bond to the shirt, without harming the material. The magnets hold the necklace in place and prevent the necklace from rotating about the neck. The part of the strap which faces outward when worn may contain a decorative embellishment which could be of varying sizes, materials, and shapes and include charms, pendants, cameos, jewels, beads, discs, metallic pieces, precious stones, semi-precious stones, lockets, and jewelry.

Figure 1B:
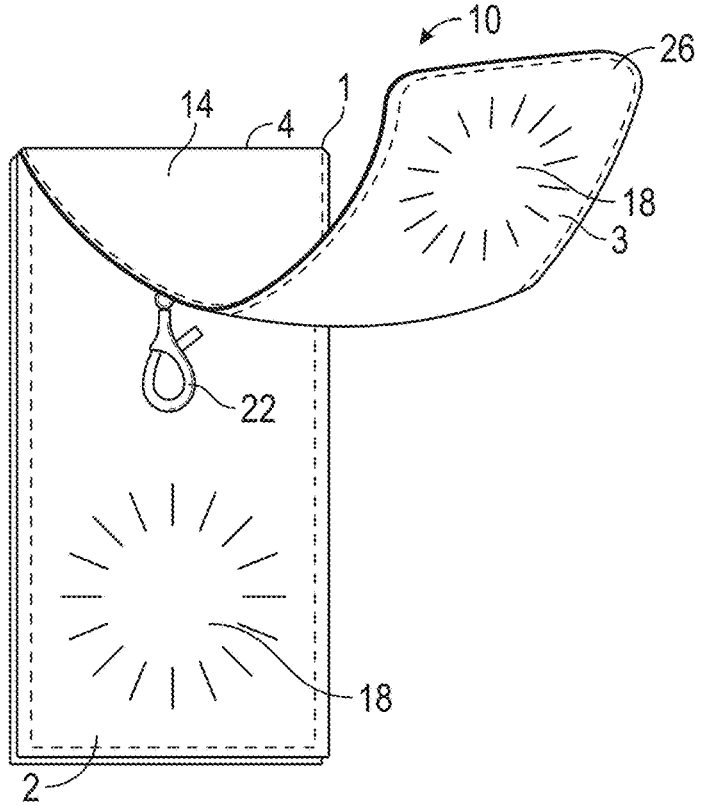
FIG. 1B is a front view of the necklace accessory with the front flap lifted.

FIG. 1B is a front view of the necklace accessory 10 with the front flap 26 lifted. From this view the clasp fastener 22, a lobster clasp, is located in the center of the inside of the strap, is visible and hanging downward.

Figure 1C:
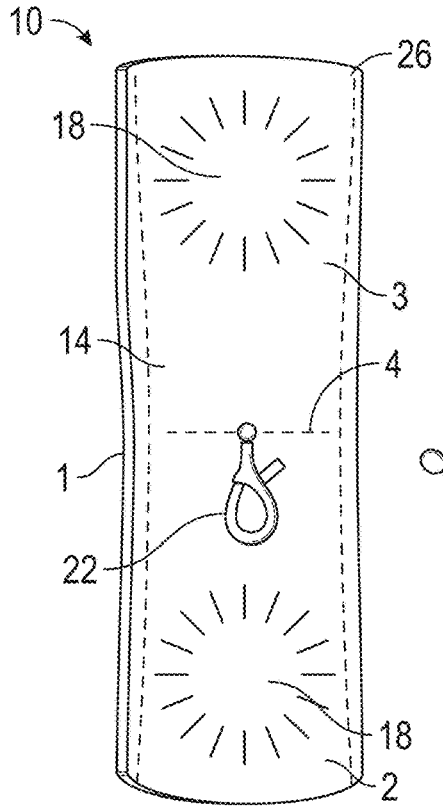
FIG. 1C is an inside front view of the necklace accessory.

FIG. 1C is an inside front view of the necklace accessory 10. This view shows how both magnets 18 are vertically centered on the strap, on opposing ends. The polarity of the magnets is configured so that the two magnets come together and attract on the side of the strap which conceals the lobster clasp fastener 22. The lobster clasp fastener 22 is affixed to the center of the strap 14 by sewing, glue adhesives, or other means of secure attachment.

Figure 1D:
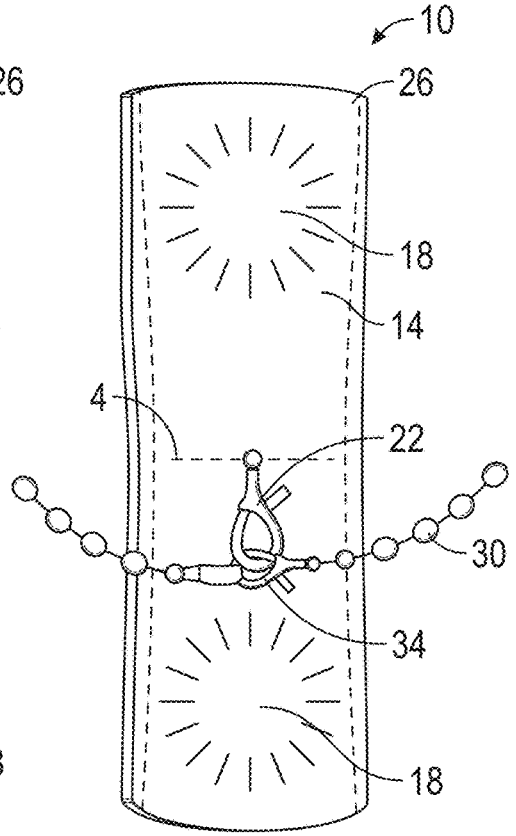
FIG. 1D is an inside front view of the necklace accessory attached to a necklace.

FIG. 1D is an inside front view of the necklace accessory 10 attached to a necklace 30. In this view the lobster clasp fastener 22 is exposed and is attached to a necklace's clasp 34 forming a secure hold. When the top flap 26 of the strap 14 is pulled over the front, the lobster clasp fastener 22 and the necklace's clasp 34 are concealed and the magnets 18 on the opposing ends are connected.

Figure 1E:
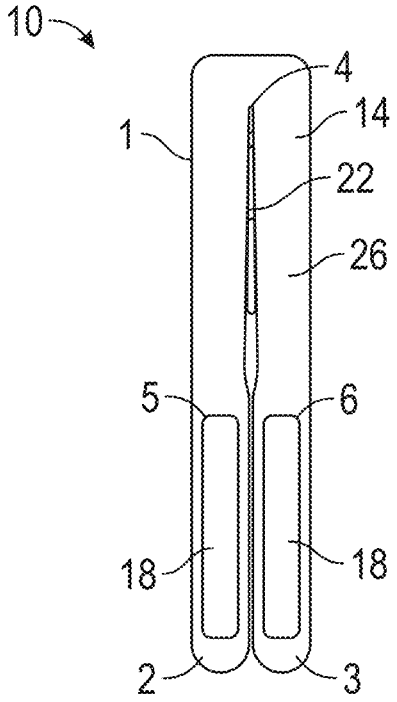
FIG. 1E is a side view of the necklace accessory.

FIG. 1E is a side view of the necklace accessory 10. In this view the magnets 18 are adjacent to each other and the side of the lobster clasp connector is visible from underneath the top of the strap 14 and/in between the sides of the strap. The strap 14 is comprised of a flexible material that can move and bend easily and will not damage the wearer's necklace. Referring to FIGS. 1A through 1E, the strap 14 may also be referred to as a folded strap 1. The folded strap 1 may have an inner portion 2, that is generally configured so that a portion of the inner portion 2 is located inside the shirt of a user. The folded strap 1 may also have an outer portion 3 that is generally configured to be located outside of the shirt of a user. The outer portion 3 is generally on the opposite side of the fold 4 from the inner portion 2. The inner portion 2 may have an inner internal volume 5 configured to hold an item such as a magnet 18. The outer portion 3 may have an outer internal volume 6 configured to hold an item such as a magnet 18.

Figure 1F:
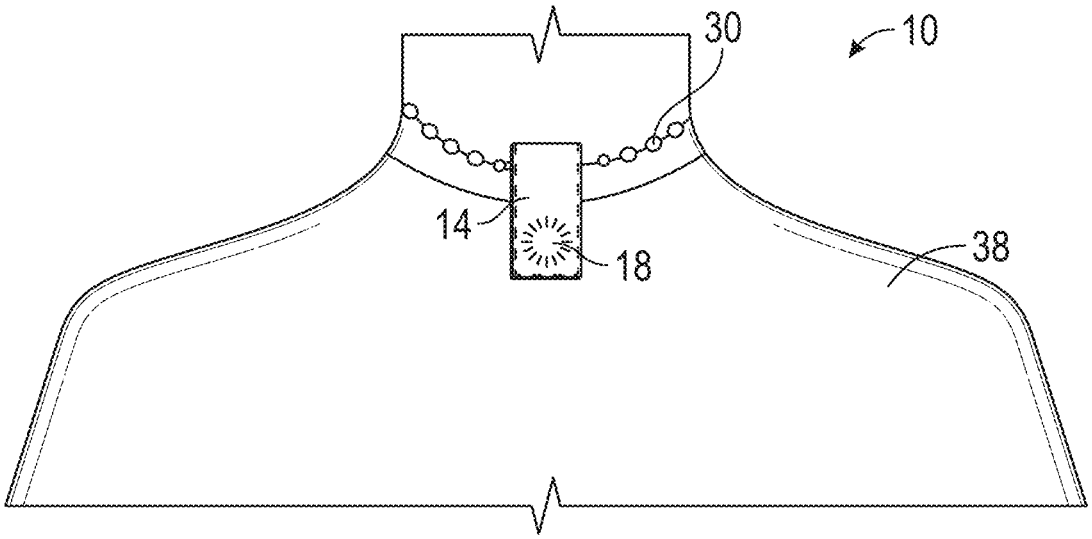
FIG. 1F is a view of the necklace accessory from FIG. 1A attached to a necklace and a shirt.
Figure 1G:
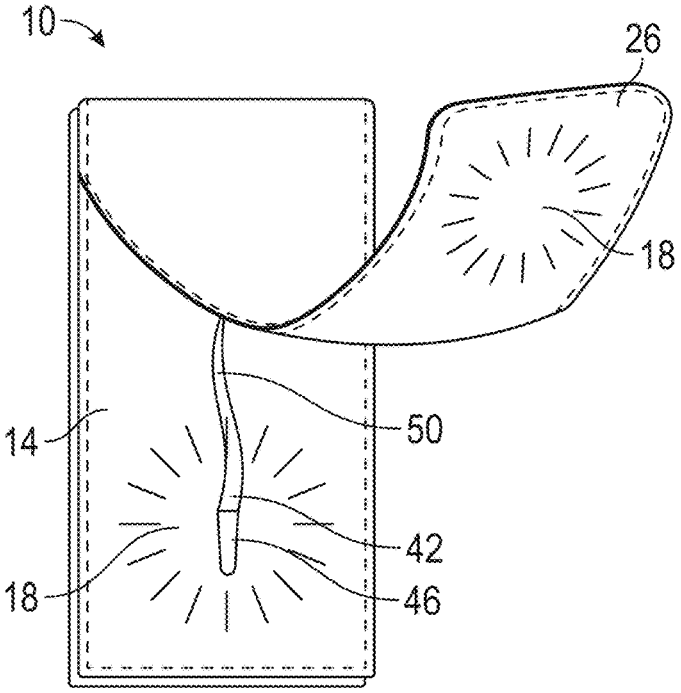
FIG. 1G is a front view of another embodiment of the necklace accessory with the front flap lifted.
Figure 1H:
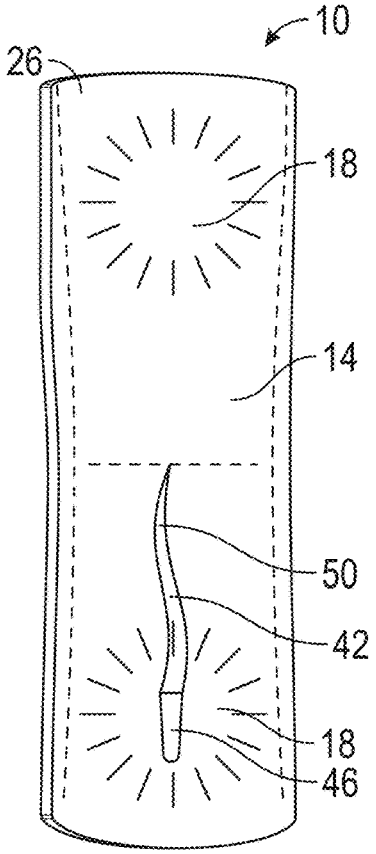
FIG. 1H is an inside front view of the necklace accessory's embodiment from FIG. 1G.

FIG. 1F is a view of the necklace accessory 10 from FIG. 1A attached to a necklace 30 and a shirt 38. In this view the wearer's necklace clasp is not visible, as it is affixed to the lobster clasp connecter on the inside of the necklace accessory 10. The back side of the strap is not visible as it is placed behind the wearer's shirt 38, just below the collar. The strap 14 is folded in the center, along where the lobster clasp fastener is placed. The front side of the strap is placed over the outside of the back of the wearer's shirt 38. The two magnets 18 will attach to each other and sandwich the shirt's material between them, keeping the wearer's necklace clasp 34 secure and steady.

Figure 1I:
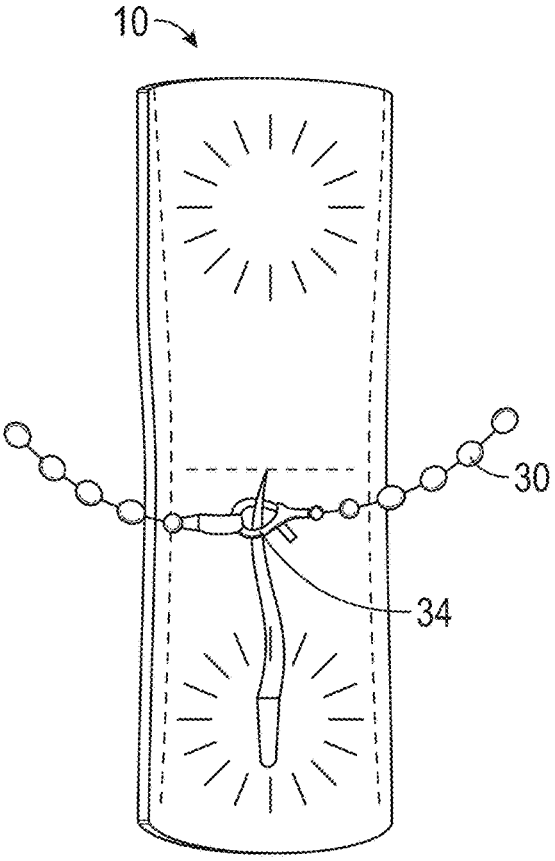
FIG. 1I is an inside front view of the necklace accessory's embodiment from FIG. 1G attached to a necklace.
Figure 1J:
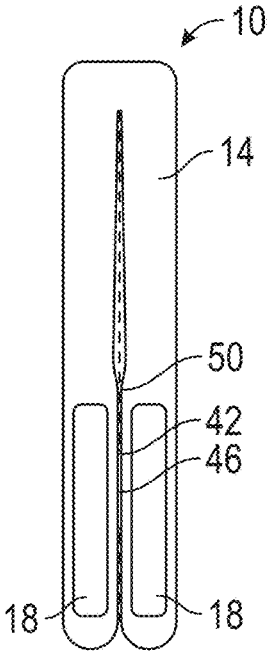
FIG. 1J is a side view of the necklace accessory's embodiment from FIG. 1G.
Figure 1K:
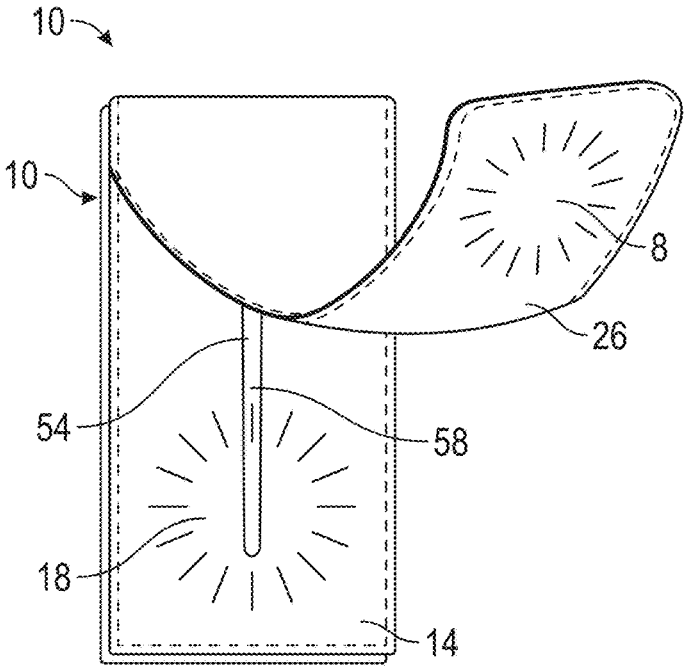
FIG. 1K is a front view of another embodiment of the necklace accessory with the front flap lifted.
Figure 1L:
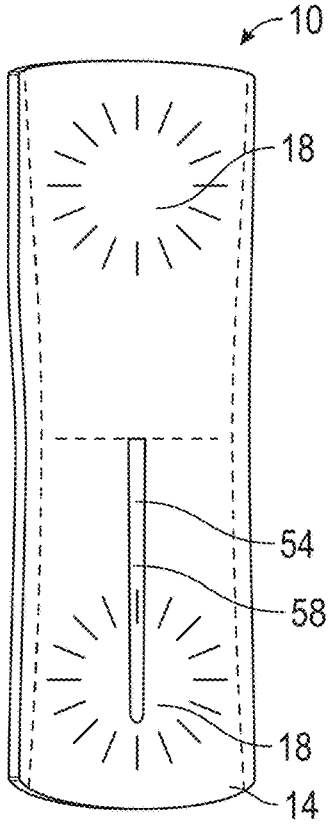
FIG. 1L is an inside front view of the necklace accessory's embodiment from FIG. 1K.

FIGS. 1G-1J show the same necklace accessory in FIGS. 1A-1F with a different embodiment for the clasp connector. In FIGS. 1G-1J the clasp connector 42 is a small, thin, and flat ferromagnetic metal piece 46, with a rounded tip, that is connected by a piece of string, cord, fishing line, or other flexible material 50 that is sewn-in, glued, or affixed by other means to the inside, center of the strap. The small piece of metal 46 on the string 50 is to be placed through the wearer's necklace clasp 34, or an adjacent jumpring, to the wearer's necklace clasp 34, if said necklace clasp does not have a loop to place the metal piece and string through. Once the metal piece on the string has been successfully placed through the wearer's necklace clasp 34 as shown in FIG. 1I, the wearer can proceed to attach the necklace accessory 10 to their shirt's collar, as shown in FIG. 1F. When the necklace accessory 10 with this embodiment is worn the magnets will sandwich the piece of ferromagnetic metal 46, along with the wearer's shirt material, tethering the wearer's necklace clasp 34 to the string 50 that is securely contained inside.

Figure 1M:
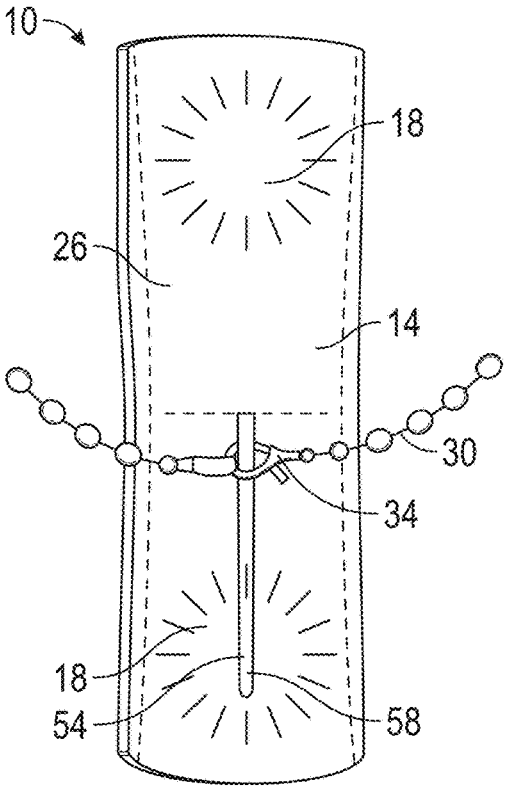
FIG. 1M is an inside front view of the necklace accessory's embodiment from FIG. 1K attached to a necklace.
Figure 1N:
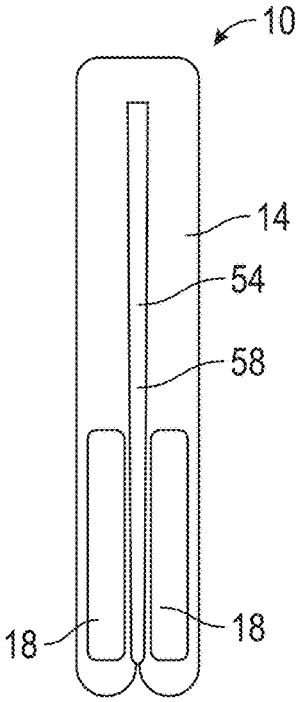
FIG. 1N is a side view of the necklace accessory's embodiment from FIG. 1K.
Figure 1O:
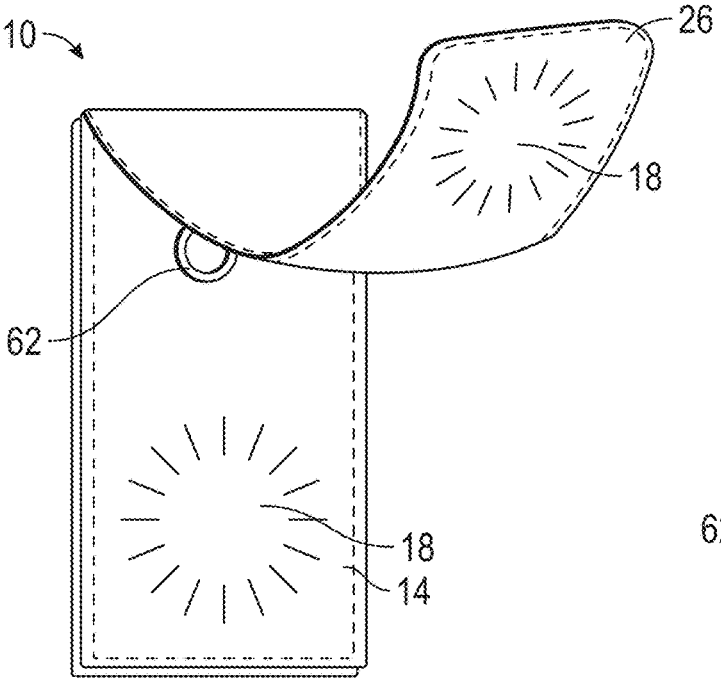
FIG. 1O is a front view of another embodiment of the necklace accessory with the front flap lifted.
Figure 1P:
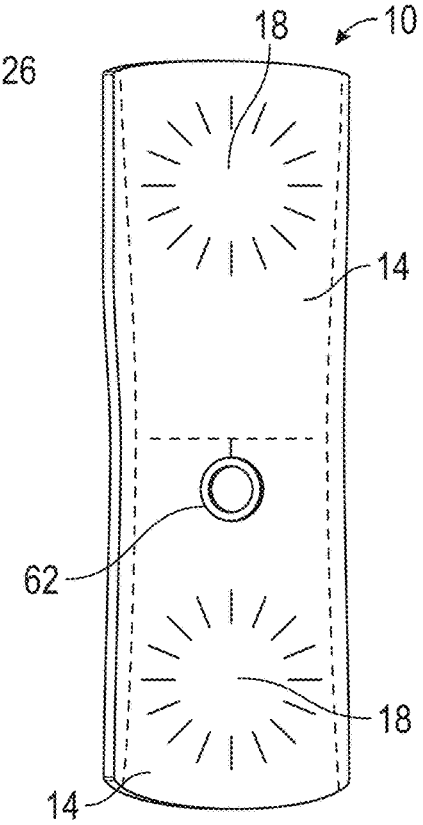
FIG. 1P is an inside front view of the necklace accessory's embodiment from FIG. 1O.

FIGS. 1K-1N show the same necklace accessory in FIGS. 1A-1F with a different embodiment for the clasp connector. In FIGS. 1K-1N the clasp connector 54 is a thin, flat ferromagnetic metal rod 58 with a rounded tip. The metal rod 58 is affixed to the center of the strap 14 by sewing, glue, welding, or other means of adhesive. The rod 58 is almost half the length of the strap 14 and is to be placed through the wearer's necklace clasp 34, or an adjacent jumpring, to the wearer's necklace clasp 34, if said necklace clasp does not have a loop to place the metal piece and string through. Once the metal rod 58 has been successfully placed through the wearer's necklace clasp 34, or adjacent jump ring (the wearer should place the metal rod through a jump ring that is attached to a fish hook, barrel, or other clasp which does not have a loop or ring to insert the metal rod through, etc.) as shown in FIG. 1M, the wearer can proceed to attach the necklace accessory to their shirt's collar, as shown in FIG. 1F. When the necklace accessory with this embodiment is worn the magnets 18 will sandwich the ferromagnetic metal rod, along with the wearer's shirt material, tethering the wearer's necklace clasp to the metal rod 58 that is securely contained inside.

Figure 1Q:
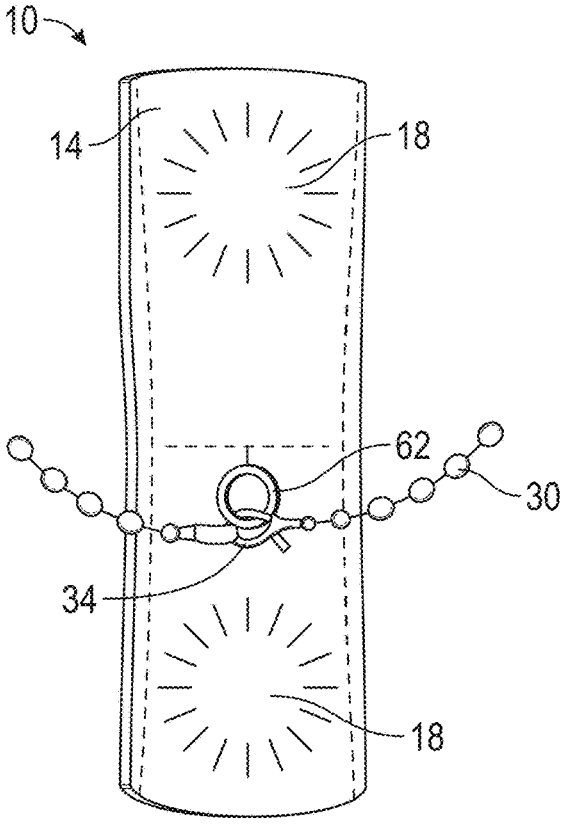
FIG. 1Q is an inside front view of the necklace accessory's embodiment from FIG. 1O attached to a necklace.
Figure 1R:
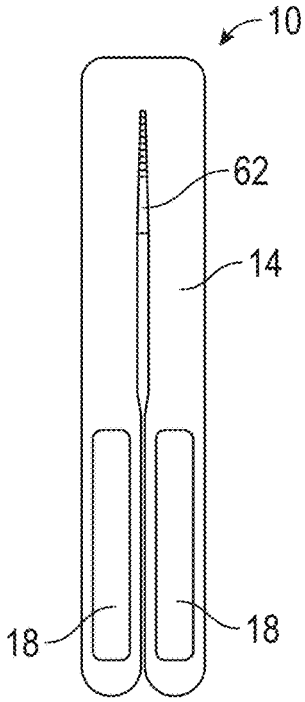
FIG. 1R is a side view of the necklace accessory's embodiment from FIG. 1O.
Figure 2D:
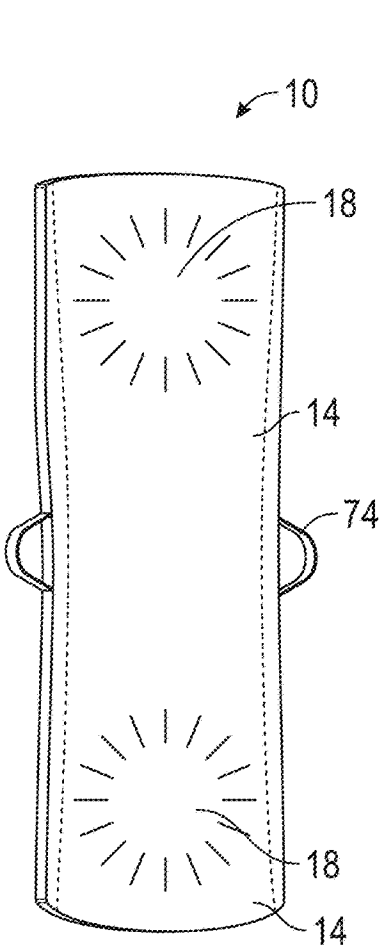
FIG. 2D is an inside front view of the necklace accessory's embodiment from FIG. 2A.
Figure 2C:
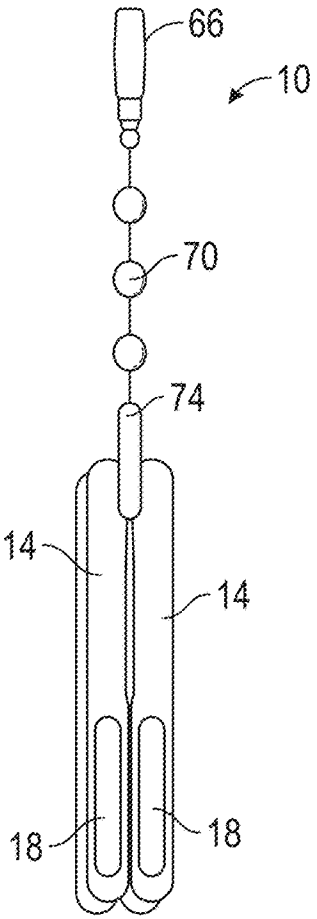
FIG. 2C is a side view of the necklace accessory's embodiment from FIG. 2A.
Figure 2B:
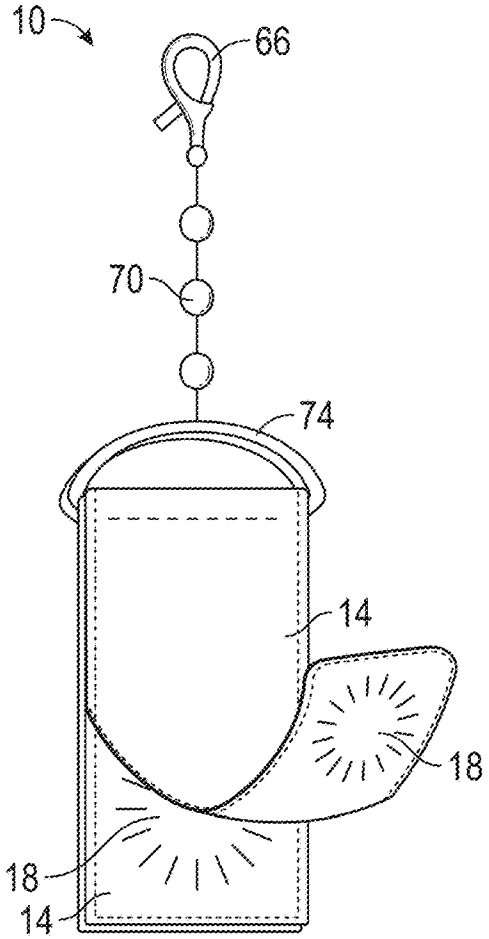
FIG. 2B is a front view of another embodiment of the necklace accessory with the front flap lifted.
Figure 2A:
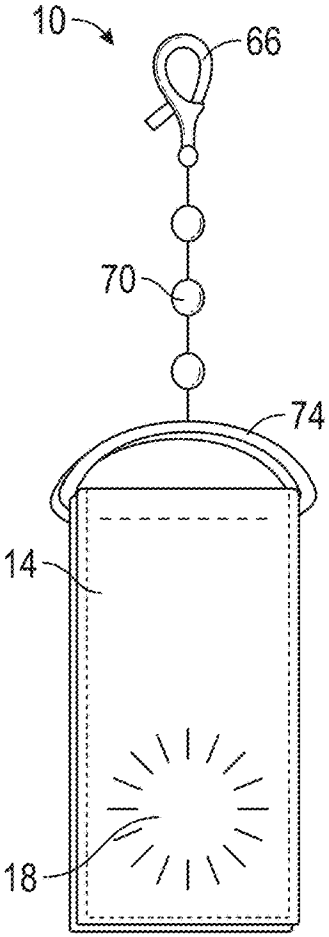
FIG. 2A is a front view of another embodiment of the necklace accessory.
Figure 2E:
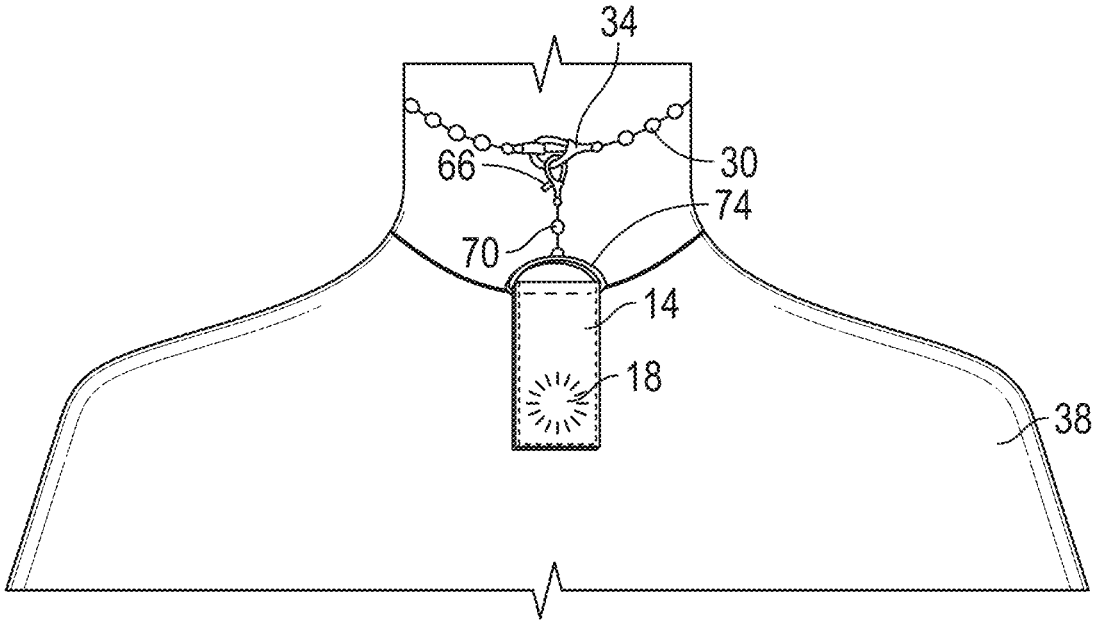
FIG. 2E is a front view of the necklace accessory's embodiment from FIG. 2A attached to a necklace and a shirt.

FIGS. 1O-1R show the same necklace accessory 10 in FIGS. 1A-1F with a different embodiment for the clasp connector. In FIGS. 1O-1R the clasp connector 62 is a closed, jump ring. The ring 62 may be any suitable ring, including but not limited to a closed round jump ring, split ring, string loop, etc. The jump ring 62 is affixed to the center of the strap by sewing, glue, welding, or other means of adhesive. In this embodiment the wearer attaches their necklaces clasp 34 to the jump ring 62. The most common necklace clasps are round spring ring clasps and lobster clasps which can be easily affixed onto the jump ring, along with the loop on the other end of the wearer's necklace. Once the jump ring 62 has been successfully connected to wearer's necklace clasp as shown in FIG. 1Q, the wearer can proceed to attach the necklace accessory to their shirt's collar, as shown in FIG. 1F. When the necklace accessory with this embodiment is worn the magnets will sandwich the wearer's shirt material, connecting the wearer's necklace clasp 34 to the jump ring 62 that is securely contained inside.

FIGS. 2A-2E illustrate another embodiment of the necklace accessory 10. This embodiment of the necklace accessory 10 has the clasp connector 66 on the outside of the strap which differs from its concealed location in FIGS. 1A-1R. The clasp connector may be a fastener such as, but not limited to a lobster clasp, round spring clasp, alligator clip, etc. The clasp connector 66, which is a lobster clasp in FIGS. 2A-2E, is attached to a length of flexible length of material 70. The flexible length of material 70 may be a length of chain, In other embodiments, instead of a length of chain 70, one may use a length of string, cord, wire, cable, or any suitable length of material. At a second end of the flexible length of material, is a clothing fastener, which in this embodiment comprises a textile strap that may have neodymium disc magnets 18 sewed-in or otherwise embedded within the strap at opposite ends. The strap 14 may be any type of cloth, fabric, woven material, plastic, silicone, leather, faux-leather, metal, chain, or any other flexible material. The strap 14 is connected to the flexible length of material 70 using a metal finding 74 that is sewn, glued, or otherwise affixed to the middle of the strap. When the wearer connects their necklace's clasp 34 to the lobster clasp connector 66, they should fold the strap 14 in halfway, placing the backend of the strap underneath their shirt 38 by the collar, and the front strap 26 over the outside of their shirt. The two magnets 18 on either end of the strap 14 will snap together and sandwich the wearer's shirt 38 in between. The shirt material 38 sandwiched between the magnets 18, thereby holding the necklace 30 in place, prevents the necklace 30 from rotating about the neck. The part of the strap 14 which faces outward when worn may contain a decorative embellishment which could be of varying sizes, materials, and shapes and include charms, pendants, cameos, jewels, beads, discs, metallic pieces, precious stones, semi-precious stones, lockets, and jewelry at the ends.

Figure 3A:
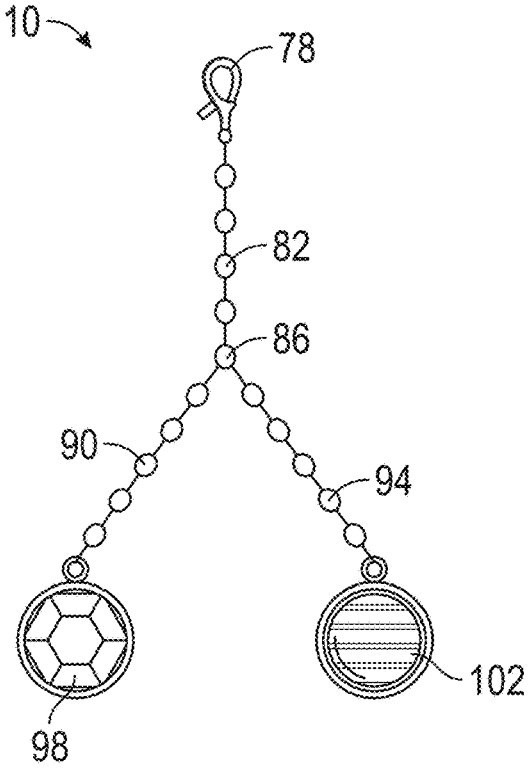
FIG. 3A is a front view of another embodiment of the necklace accessory.

FIG. 3A illustrate another embodiment of the necklace accessory. The necklace accessory comprises a necklace fastener 78. The fastener may be a clasp fastener such as, but not limited to a lobster clasp, round spring clasp, alligator clip, etc. The fastener is attached to a first flexible length of material 82. The second end 86 of the first flexible length of material branches off into two different flexible lengths of material, a third flexible length of material 90 that goes in front of the wearer's shirt and a second flexible length of material 94 that is placed behind the shirt. The third flexible length of material 90 that is intended to go outside of the wearer's shirt, contains a decorative element 98 with a magnet embedded within it on the end. The back piece of the second flexible length of material 94 that goes behind the wearer's shirt contains a clothing fastener 102, which in this embodiment comprises a magnet. In one embodiment, the magnet may be a flat neodymium disc magnet embedded in a pendant/charm tray—so the back and sides of the magnet are not exposed. The front, exposed side of the magnet is configured to abut the inside of the wearer's shirt. The first, second, and third flexible lengths of material may be lengths of chain, string, cord, wire, cable, or any suitable length of material.

Figure 3B:
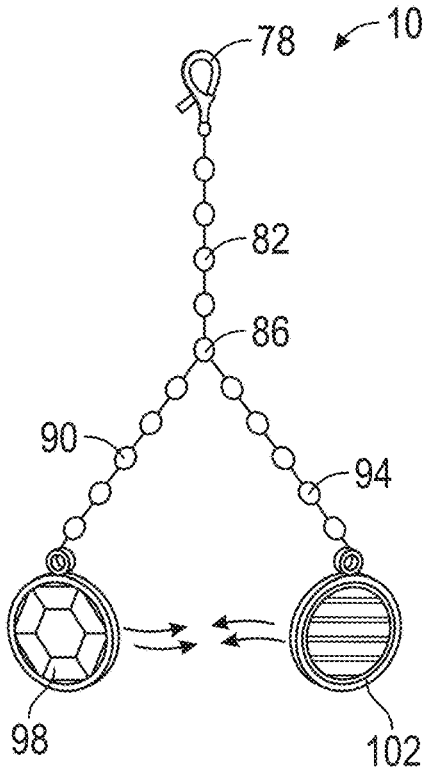
FIG. 3B is a slightly rotated front perspective view of the necklace accessory's embodiment from FIG. 3A.

FIG. 3B is a slightly rotated front perspective view of the necklace accessory's embodiment from FIG. 3A. The arrows represent the magnets attracted forces to each other.

Figure 3C:
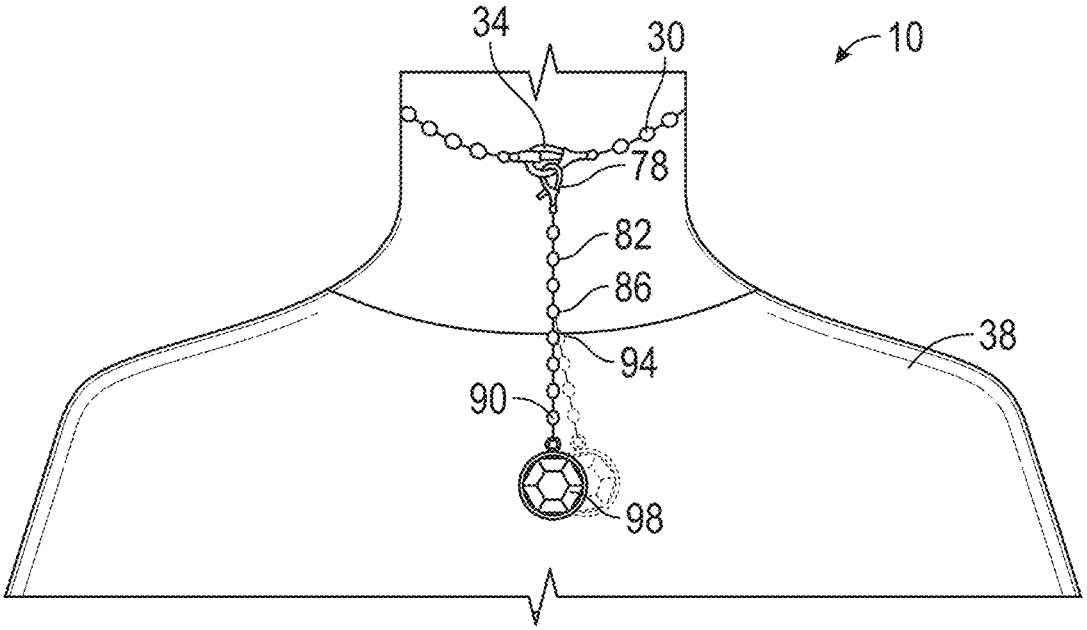
FIG. 3C is a front view of the necklace accessory's embodiment from FIG. 3A attached to a necklace and a shirt.

FIG. 3C is a front view of the necklace accessory's embodiment from FIG. 3A attached to a necklace and a shirt. Within this illustration you could see a portion of the second flexible length of material 94 with the magnet behind it that goes behind the shirt. In this figure, the decorative element is magnetically attached to the magnet, thereby holding the necklace in place and preventing the necklace from rotating about the neck.

Figure 4A:
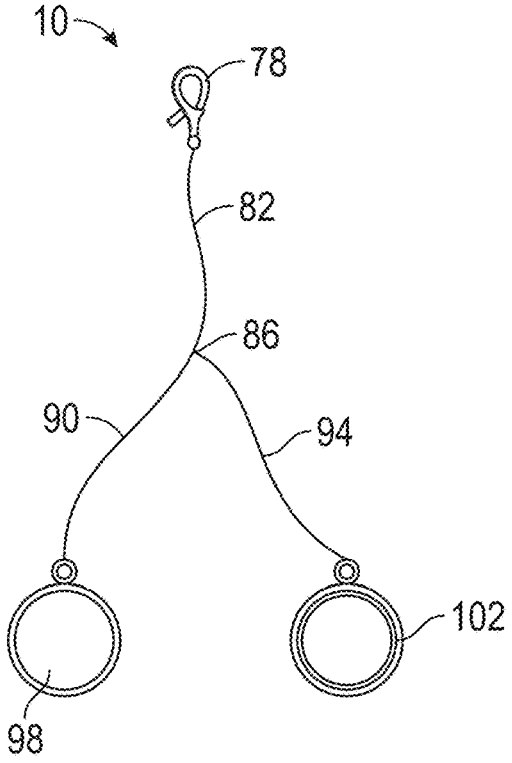
FIG. 4A is a front view of another embodiment of the necklace accessory.
Figure 4B:
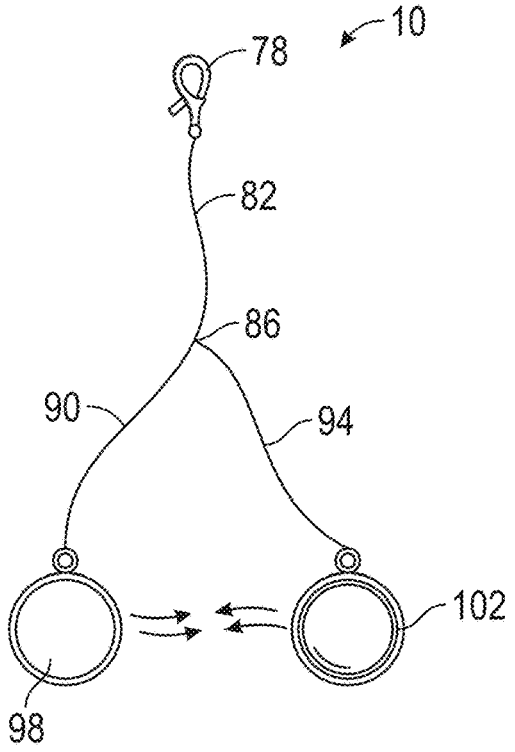
FIG. 4B is a slightly rotated front perspective view of the necklace accessory's embodiment from FIG. 4A.
Figure 4C:
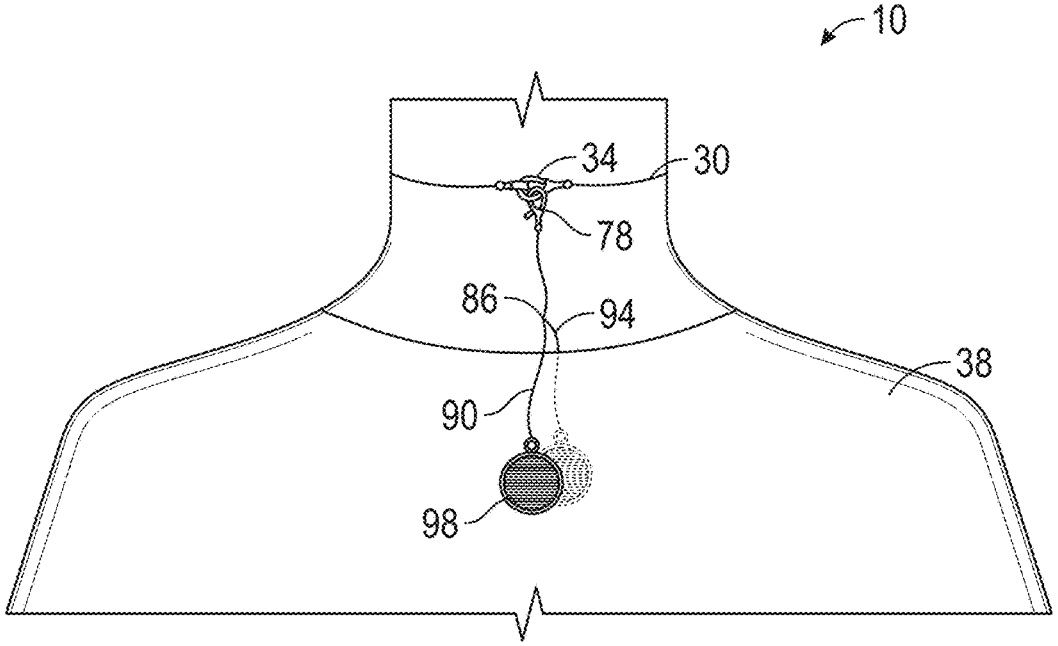
FIG. 4C is a front view of the necklace accessory's embodiment from FIG. 4A attached to a necklace and a shirt.

FIGS. 4A-C represent similar embodiments reflected in FIGS. 3A-C respectively. One difference in these figures are the materials used. The embodiments in FIGS. 4A-C use a wire material, instead of chain as shown in FIGS. 3A-C. Additionally, the outer decorative element in FIGS. 4A-C are more simple, and do not contain a rhinestone as shown in FIGS. 3A-3C.

Figure 5:
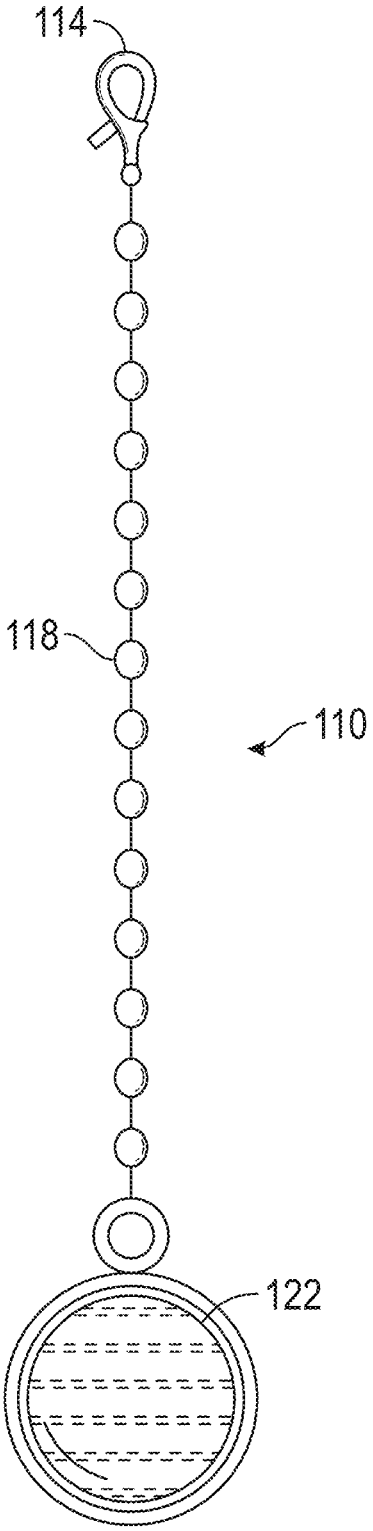
FIG. 5 is a front view of the disclosed necklace accessory.

FIG. 5 is a front view of the necklace accessory 110. The necklace accessory 110 comprises a necklace fastener 114. The fastener 114 may be a clasp fastener such as, but not limited to a lobster clasp, round spring clasp, alligator clip, etc. The fastener is attached to a flexible length of material 118. The flexible length of material 118 may be a length of chain, a length of string, cord, wire, cable, or any suitable length of material. At a second end of the flexible length of material 118, is a clothing fastener, which in this embodiment comprises a magnet 122 and a decorative element 126 that comprises a magnetic material (see FIG. 7). The decorative element 126 is removeably attachable to the magnet 122. In one embodiment, the magnet 122 may be a flat neodymium disc magnet embedded in a pendant/charm tray—so the back and sides of the magnet are not exposed. The front, exposed side of the magnet 122 is configured to abut the inside of the wearer's shirt. In this document, a shirt shall be defined to include a shirt, blouse, or top. In another embodiment, the clothing fastener may comprise a ferromagnetic metal material attached to the chain 118, with a decorative element 126 made out of a magnet which magnetically attaches to the ferromagnetic metal material.

Figure 6:
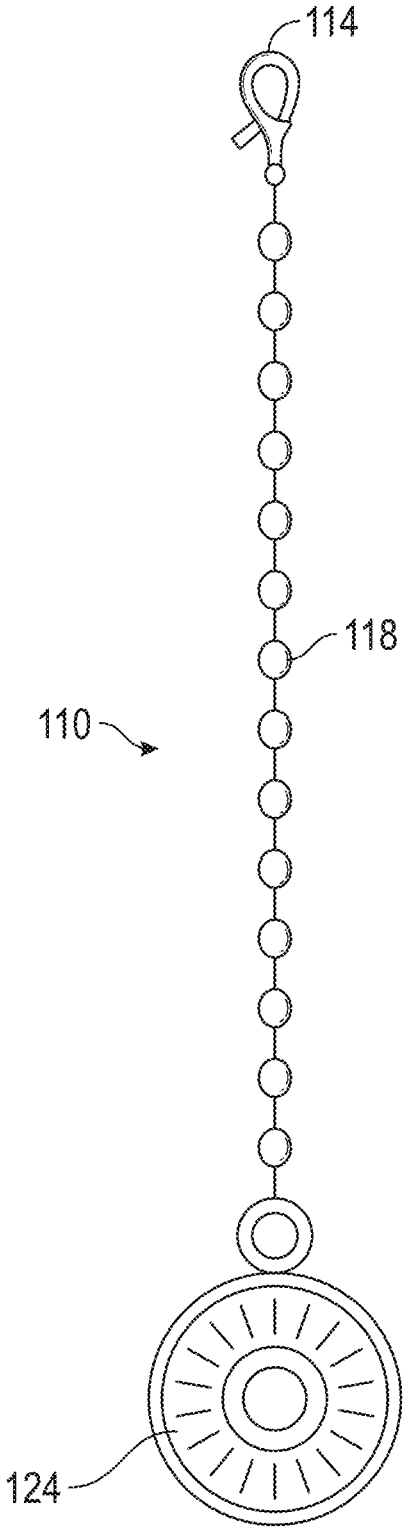
FIG. 6 is a front view of another embodiment of the necklace accessory.

FIG. 6 shows another embodiment of the necklace accessory 110. In this embodiment, the clothing fastener comprises a snap fastener 124. A decorative element snap backing 134 is configured to removeably attach to the snap fastener 124, with shirt material sandwiched between the snap fastener 124 and decorative element snap backing.

Figure 7:
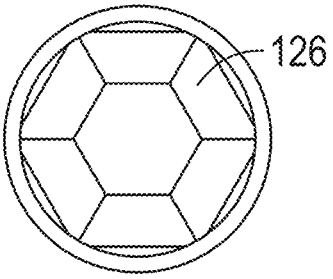
FIG. 7 is a front view of a decorative element.

FIG. 7 shows a front view of the decorative element 126. The decorative element 126 is configured to magnetically attach to the magnet 122, with the shirt material sandwiched between the decorative element 126 and magnet 122. The decorative embellishment could be of varying sizes, materials, and shapes and include charms, pendants, cameos, jewels, beads, discs, metallic pieces, precious stones, semi-precious stones, lockets, and jewelry. The decorative element 126 is placed in proximity to the magnet 122 (that is located behind the wearer's shirt and attached to flexible length of material 118) from the outside of the wearer's shirt. Once the magnets or magnet/ferromagnetic metal material are close to each other the strong force of the magnet attraction will fasten the decorative element 126 to the magnet 122, with the shirt material sandwiched between the decorative element 126 and the magnet 122.

Figure 8:
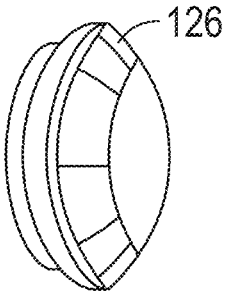
FIG. 8 is a side perspective view of the decorative element from FIG. 7.

FIG. 8 is a side perspective view of the decorative element 126.

Figure 9:
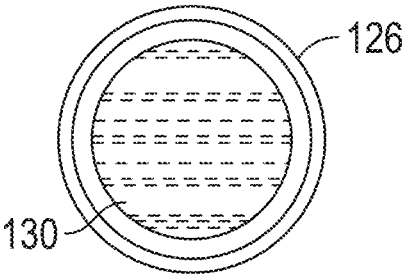
FIG. 9 is rear view of the decorative element from FIG. 7.

FIG. 9 is a back view of the decorative element 126. In this view, the ferromagnetic metal material surface 130 is visible.

Figure 10:
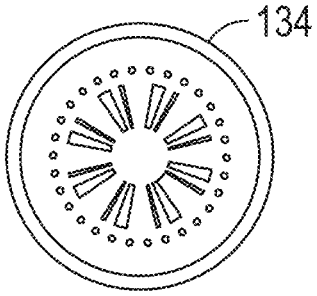
FIG. 10 is a back view of another embodiment of a decorative element.

FIG. 10 shows another embodiment of the decorative element 134. In this embodiment, the decorative element 134 is a snap backing configured to snap onto the snap fastener 124 of FIG. 6 with the shirt material sandwiched between the snap backing decorative element 134 and the snap fastener 124.

Figure 11:
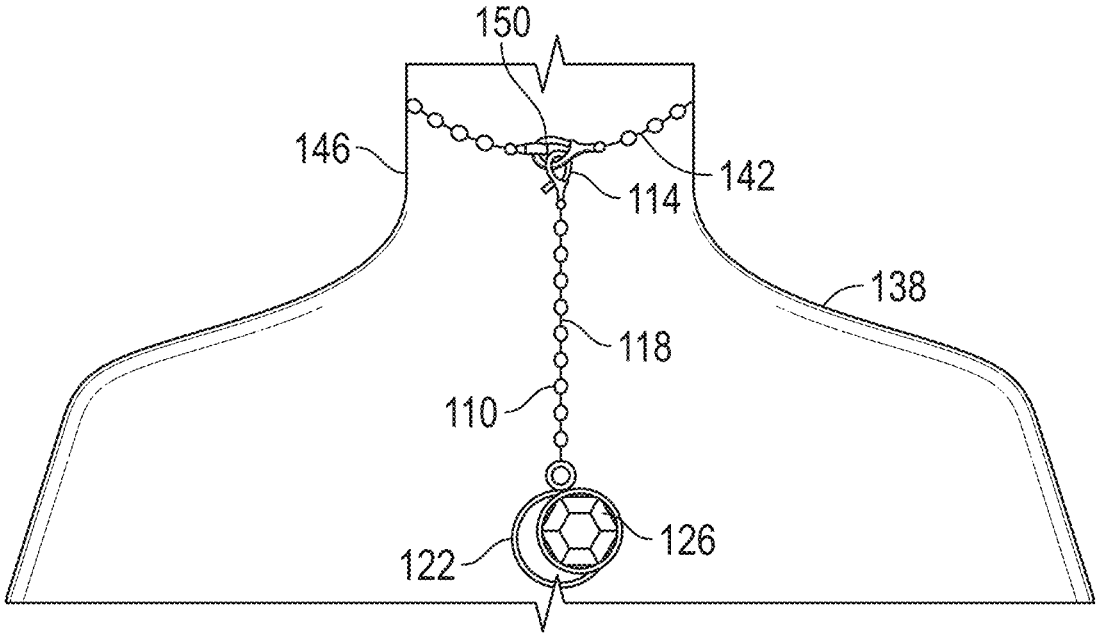
FIG. 11 is a view of the necklace accessory attached to a necklace.

FIG. 11 shows a rear view of a user 138. The user has a necklace 142 located on her neck 146. A necklace 142 is located on the user's neck 146. The necklace has a clasp 150. The necklace accessory 110 is removeably attachable to the clasp 150 via the necklace fastener 114. The decorative element 126 is shown slightly removed from the magnet 122.

Figure 12:
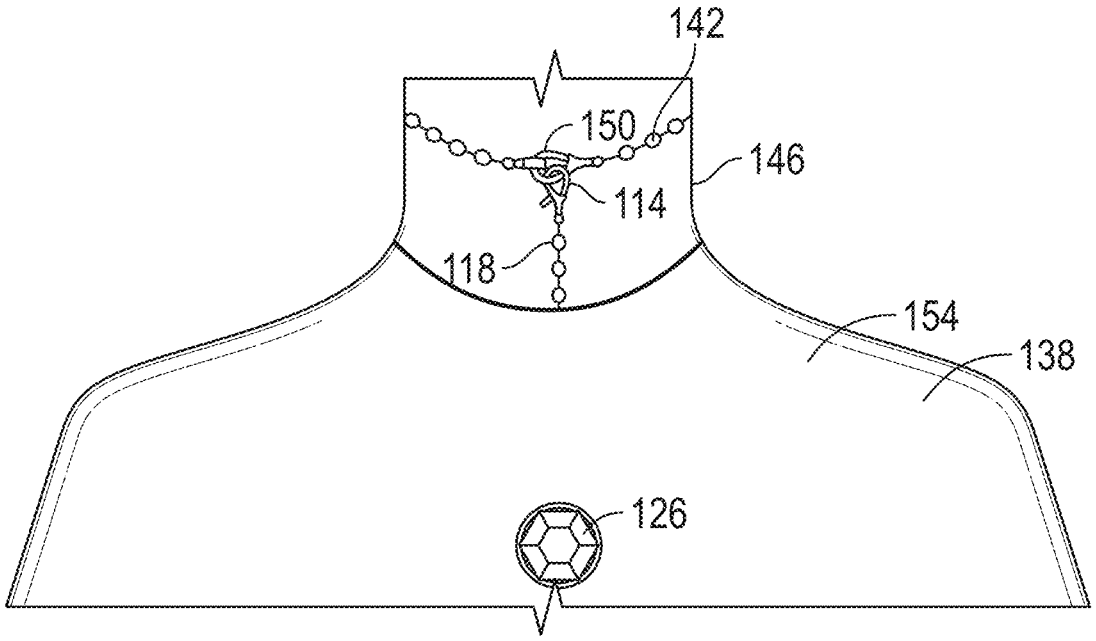
FIG. 12 is a view of the necklace accessory attached to a necklace and a shirt.

FIG. 12 shows a rear view of the user 138 from FIG. 11, but in this figure the user 138 is wearing a shirt 154. In this figure, the decorative element 126 is magnetically attached to the magnet 122 (which is not visible behind the shirt 154) with the shirt material sandwiched between the magnet 122 and decorative element 126, thereby holding the necklace 142 in place and preventing the necklace 142 from rotating about the neck 146. As described above, the magnet 122 and decorative element 126 may be substituted with another attachment means, such as a snap fastener disclosed in FIGS. 6 and 10.

Figure 13:
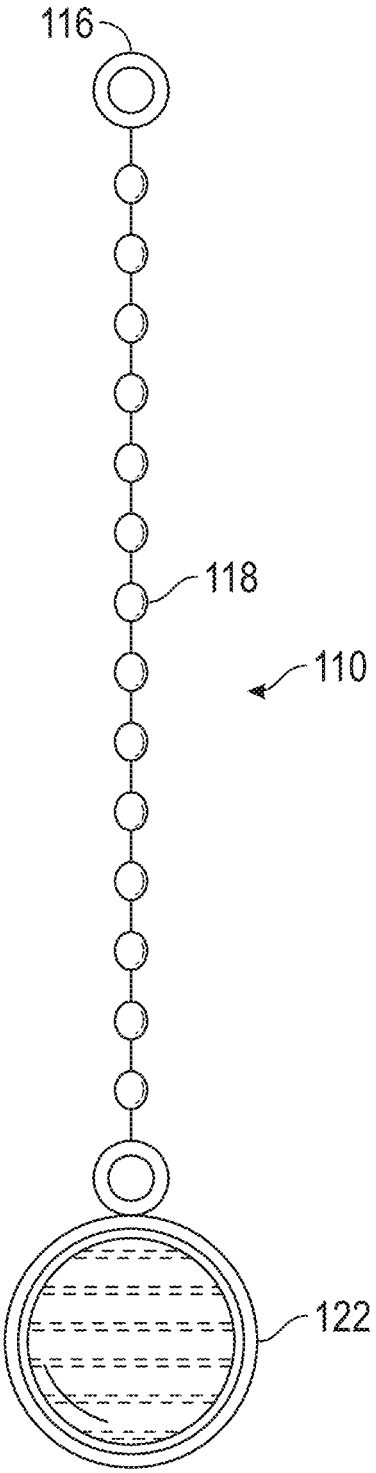
FIG. 13 is a front view of another embodiment of the necklace accessory.

FIG. 13 shows another embodiment of the necklace accessory 110. In this embodiment, instead of a necklace fastener 114, the necklace accessory 110 comprises a ring 116. The ring 110 may be any suitable ring, including but not limited to a closed round jump ring, split ring, string loop, etc.

Figure 14:
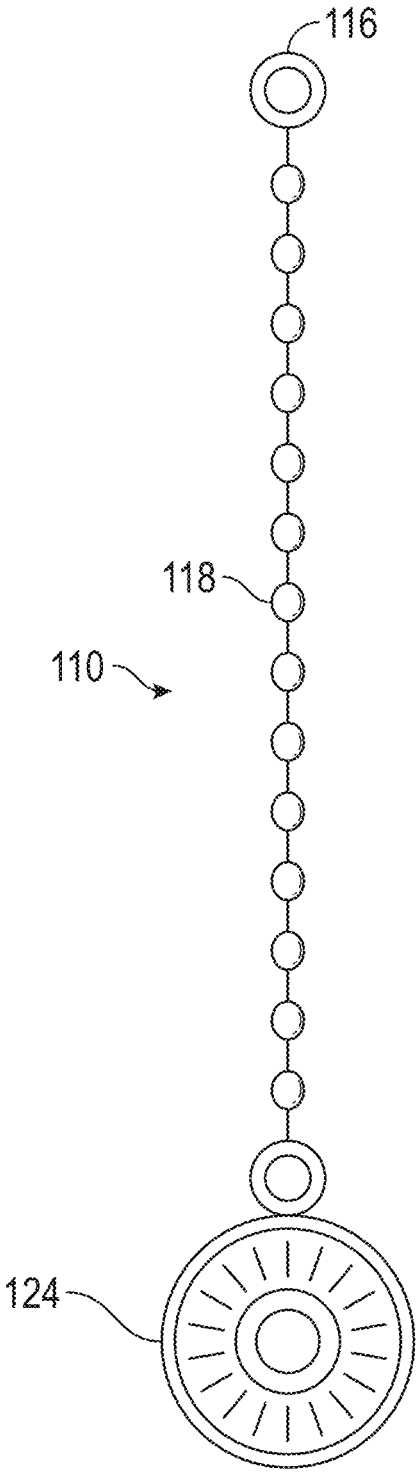
FIG. 14 is a front view of another embodiment of the necklace accessory.

FIG. 14 shows another embodiment of the necklace accessory 110. This embodiment is a modification of the snap fastener embodiment from FIG. 6. However, instead of a necklace fastener 114, the necklace accessory 110 comprises a ring 116.

Figure 15:
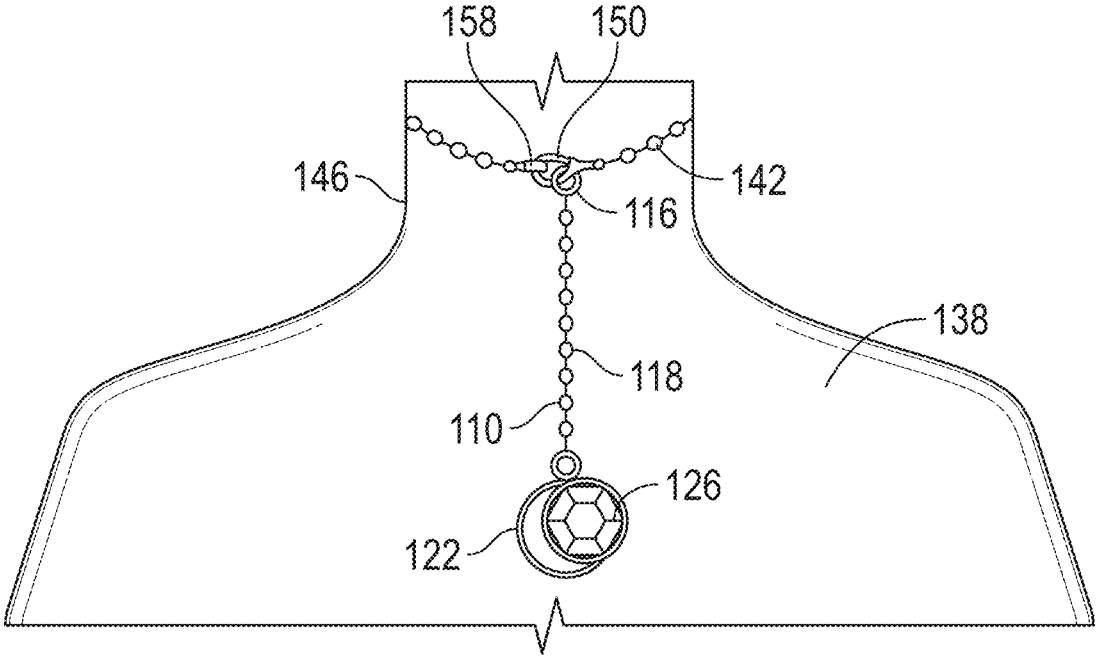
FIG. 15 is a view of another embodiment of the necklace accessory attached to a necklace.

FIG. 15 shows a rear view of a user 138. The user has a necklace 142 located on her neck 146. A necklace 142 is located on the user's neck 146. The necklace has a clasp 150. The necklace accessory 110 from FIG. 19 is removeably attachable to the clasp 150 via the ring 116. The decorative element 126 is shown slightly removed from the magnet 122. The user simply opens the necklace's clasp 150 and attaches the ring 116 to the clasp 150 and to the loop 158 of the necklace 142 (to secure the clasp 150 to the other end of the necklace 142).

Figure 16:
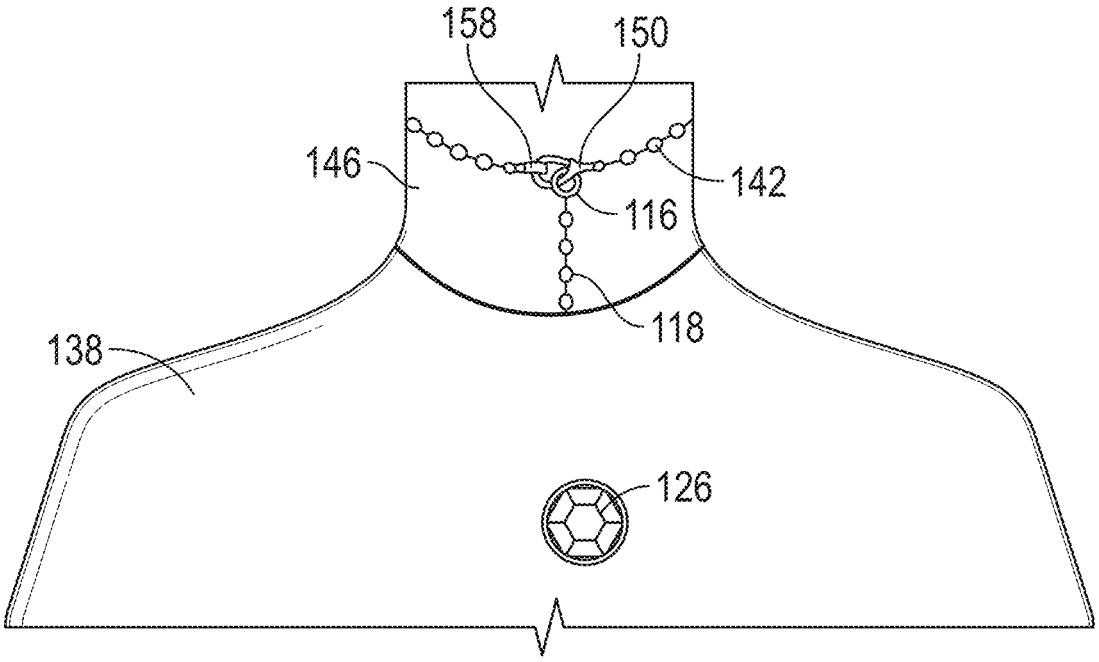
FIG. 16 is a view of the necklace accessory from FIG. 15 attached to a necklace and a shirt.

FIG. 16 shows a rear view of the user 138 from FIG. 15, but in this figure the user 138 is wearing a shirt 154. In this figure, the decorative element 126 is magnetically attached to the magnet 122 (which is not visible behind the shirt 154), thereby holding the necklace 142 in place and preventing the necklace 142 from rotating about the neck 146. As described above, the magnet 122 and decorative element 126 may be substituted with another attachment means, such as a snap fastener disclosed in FIGS. 6 and 10

The disclosed necklace accessory may be attached to the wearer's necklace's clasp and may be placed behind their shirt. A clasp fastening mechanism may be used to attach the disclosed necklace accessory to the wearer's necklace. This may be a lobster clasp or a round spring clasp, This may be secured to the wearer's necklace's clasp (or jump ring next to clasp) to keep it steady. One embodiment of the disclosed necklace accessory may use: Sterling Silver Spring Ring Round Clasps Open Ring 5 mm. In addition, the disclosed necklace accessory may comprise a connecting chain about 3 inches in length, something strong and dainty. In one embodiment, the connecting chain may be a Sterling Silver Rolo Chain—1.5 mm Rolo Chain that has all links soldered. The disclosed necklace accessory may comprise two jump rings that attach the clasp and the pendant tray to the chain. These jump rings may be strong as they may encounter some resistance. Jumplock rings may be used as an alternative to soldering.

The disclosed necklace accessory may also use in one embodiment a magnet which has a pulling force of 2.1 Pounds, such as a Neodymium Rare Earth Disc Magnet—Strength: N52—Size: 5/16"×1/16". Stronger magnets may be used. Each necklace accessory may have two magnets—one that goes behind the shirt—and one on the outside of the shirt. Another magnet that may be used is a Neodymium Disc Magnet Strength: N52—Size: ½"×⅛"—Pulling force: 7.5 pounds.

In one embodiment, the necklace accessory may comprise a flat neodymium disc magnet embedded in a pendant/charm tray. In one embodiment, a Stainless Steel Silver Bezel Pendant Tray in 8×8 mm size may be used. In other embodiments, a 10×10 mm pendant tray may be used to accommodate a slightly larger magnet. In one embodiment, super glue may be used to embed the magnet in the tray—so the back and sides of the magnet are not exposed. The front, exposed side of the magnet may be covered in a thin layer of epoxy glue to embed magnet in the tray—so the back and sides of the magnet are not exposed. This is the side of the device that goes against the inside of the wearer's shirt. As an alternative to epoxy to cover the magnet, a flat metal round disc can be placed on top of the magnet in the pendant tray. Then the sides of the tray may be folded in to keep the disc embedded and provide a beveled edge. An epoxy-coated magnet can be used for this as well, which maybe more efficient.

A decorative element/embellishment may be attached using super glue to a flat neodymium disc magnet. In one embodiment, the decorative element may be a Swarovski 2088 8.5 mm (SS40) Crystal Flat Back rhinestone. The combined, super-glued, decorative embellishment (i.e. rhinestone) and neodymium disc magnet may then be super-glued into a bezel tray setting. In one embodiment, a 10 mm Stainless Steel Bezel Tray Setting may be used. Once the rhinestone, magnet, and bezel tray have been glued together and is ready to go, it can be placed on the wearer's necklace. Once the magnetic elements are placed close to each other the strong force of the magnet attraction will fasten the elements to each other. This combined accessory will act as a tether and prevent the necklace from rotating around the wearer's neck.

The disclosed necklace accessory has many advantages. The necklace accessory prevents a necklace from rotating on a user's neck, thereby preventing the clasp of the necklace from moving from the back of the neck to the front of the neck. The necklace accessory may be aesthetically pleasing, so that even if it is visible on the back of the neck, it appears as jewelry itself. The decorative element that attaches to the back of shirt is aesthetically pleasing. The decorative element will not put holes in a shirt. The necklace accessory attaches to the clasp of a necklace, thereby preventing rotation of the necklace about the user's neck. The necklace accessory may be used to make the wearer's necklace appear shorter/drop higher in the front of the wearer by pulling the connected necklace accessory with the decorative element downward along the back of the shirt. The necklace accessory may also be used to prevent unsightly clothing tags from inadvertently sticking up out of the back of the shirt near the collar, by sandwiching the tags them between the magnetic elements, along with the shirt material, keeping them hidden. Also, the means of securing a necklace clasp fastener to the wearer's shirt is not limited to magnets, but may include other fastening means, including but not limited to clips, snaps, Velcro, buttons, buckles, hooks, etc. The disclosed necklace accessory also helps prevent hair from getting tangled in the necklace clasp. In most cases, the disclosed necklace accessory can be used with a broken necklace clasp, by attaching it to an adjacent jump ring, making said necklace wearable again. Unlike counterweight solutions which require a weighted element on the necklace clasp to balance the pendant weight and do not work well with lightweight necklaces, bending, and high physical activity, the disclosed necklace accessory can be used on all necklaces, positions, activity level, and virtually all clasp types. The disclosed necklace accessory can be used while wearing multiple layered necklaces to prevent tangling It should be noted that the terms "first", "second", and "third", and the like may be used herein to modify elements performing similar and/or analogous functions. These modifiers do not imply a spatial, sequential, or hierarchical order to the modified elements unless specifically stated. In this application, neodymium disc magnets have been disclosed as one embodiment of magnets used in the necklace accessory, however, one of ordinary skill will recognize that the neodymium disc magnets may be replaced by any suitable magnet, and the use of any other suitable magnet in place of the neodymium disc magnets is part of this disclosure.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A necklace accessory, the necklace accessory comprising:

a clothing fastener;

a decorative element configured to removably attach to the clothing fastener;

a flexible length of material non-magnetically attached to either the clothing fastener or the decorative element;

a necklace fastener non-magnetically attached to the flexible length of material on an end opposite either the clothing fastener or the decorative element, the necklace fastener configured to removably and non-magnetically attach to a necklace worn by a user via a clasp type fastener or a jump ring;

wherein the clothing fastener is configured to removably attach to the decorative element with a shirt between the clothing fastener and the decorative element, and whereby when the necklace fastener is attached to the necklace and the clothing fastener and decorative element are attached to the shirt, the necklace accessory prevents the necklace from rotating about a user's neck.

2. The necklace accessory of claim 1, wherein the clothing fastener comprises a first magnet, and the decorative element comprises a second magnet that is magnetically attracted to the first magnet.

3. The necklace accessory of claim 2, wherein the clothing fastener comprises a first charm tray, with the first magnet located inside the first charm tray so the back and sides of the first magnet are enclosed in the first charm tray and only the front side of the first magnet is exposed; and wherein the decorative element comprises a second charm tray, with the second magnet located inside the second charm tray so the back and sides of the second magnet are enclosed in the second charm tray and only the front side of the second magnet is exposed.

4. The necklace accessory of claim 1, wherein the clothing fastener is configured to snap onto the decorative element.

5. The necklace accessory of claim 1, wherein the flexible length of material is chain, wire, or cord.

6. The necklace accessory of claim 1, wherein the necklace fastener is a lobster clasp or round spring clasp.

7. The necklace accessory of claim 1, wherein the flexible length of material is non-magnetically attached to either the clothing fastener or the decorative element via a lobster clasp, round spring clasp, closed round jump ring, split ring, or a jump ring; and wherein the necklace fastener is non-magnetically attached to the flexible length of material on an end opposite either the clothing fastener or the decorative element via a lobster clasp, round spring clasp, closed round jump ring, split ring, or a jump ring.

8. The necklace accessory of claim 1, wherein the flexible length of material is non-magnetically attached to either the clothing fastener or the decorative element via a lobster clasp, round spring clasp, closed round jump ring, split ring, or a jump ring; and wherein the necklace fastener is non-magnetically attached to the flexible length of material on an end opposite either the clothing fastener or the decorative element via a lobster clasp, round spring clasp, closed round jump ring, split ring, or a jump ring.

9. The necklace accessory of claim 1, wherein the clothing fastener comprises a first charm tray, with a magnet located inside the first charm tray so the back and sides of the magnet are enclosed in the first charm tray and only the front side of the magnet is exposed; and wherein the decorative element comprises a second charm tray, with a ferromagnetic metal material located inside the second charm tray so the back and sides of the ferromagnetic metal material are enclosed in the second charm tray and only the front side of the ferromagnetic metal material is exposed.

* * * * *